US010975593B2

(12) United States Patent
Walker et al.

(10) Patent No.: US 10,975,593 B2
(45) Date of Patent: Apr. 13, 2021

(54) RAILING SYSTEM

(71) Applicant: Peak Innovations Inc., Richmond (CA)

(72) Inventors: Simon Walker, Delta (CA); Craig Lawson, Burnaby (CA); Charles Young, Vancouver (CA)

(73) Assignee: Peak Innovations Inc., Richmond (CA)

( * ) Notice: Subject to any disclaimer, the term of this patent is extended or adjusted under 35 U.S.C. 154(b) by 582 days.

(21) Appl. No.: 15/760,189

(22) PCT Filed: Sep. 16, 2015

(86) PCT No.: PCT/CA2015/050906
§ 371 (c)(1),
(2) Date: Mar. 14, 2018

(87) PCT Pub. No.: WO2017/045056
PCT Pub. Date: Mar. 23, 2017

(65) Prior Publication Data

US 2018/0274262 A1 Sep. 27, 2018

(51) Int. Cl.
*E04H 17/14* (2006.01)
*E04F 11/18* (2006.01)

(52) U.S. Cl.
CPC ..... *E04H 17/1439* (2013.01); *E04F 11/1842* (2013.01); *E04F 2011/1827* (2013.01); *E04H 17/1452* (2021.01)

(58) Field of Classification Search
CPC ..... E04F 11/1842; E04F 2011/1827; E04H 17/1426; E04H 17/1439; E04H 2017/1452; E04H 17/1452
USPC ..... 256/22, 59, 65.11, 65.12
See application file for complete search history.

(56) References Cited

U.S. PATENT DOCUMENTS 2,771,276 A * 11/1956 Constance, Jr. ..... E04F 11/181 256/22
3,485,006 A * 12/1969 De Rozario ..... E04F 11/1817 256/65.01
3,955,799 A * 5/1976 Lauzier ..... E04F 11/1817 256/65.11

(Continued)

FOREIGN PATENT DOCUMENTS

CA 1306633 8/1992
CA 2200265 8/2001

*Primary Examiner* — Josh Skroupa
(74) *Attorney, Agent, or Firm* — Smiths IP; Lawrence Chan

(57) ABSTRACT

A rail for a railing system with pickets comprises an elongated cover portion and an elongated side portion. The cover portion comprises an elongated top surface, one or more first connectors proximate to a lateral end of the top surface, a plurality of shelves interspersed between successive ones of the pickets, and one or more second connectors. Each of the shelves comprises a first end, and each of the second connectors extends from at least some of the first ends. The elongated side portion comprises one or more third connectors and one or more fourth connectors. The third connectors are adapted to engage with the one or more first connectors, and the fourth connectors are adapted to engage with the one or more second connectors. The side portion is secured to the cover portion by engagement of the third connectors with the first connectors and by engagement of the fourth connectors with the second connectors.

19 Claims, 8 Drawing Sheets

(56) References Cited

U.S. PATENT DOCUMENTS

| | | | | | |
|---|---|---|---|---|---|
| 3,973,756 | A * | 8/1976 | Lauzier | E04F 11/181 | 256/65.11 |
| 3,975,000 | A * | 8/1976 | Sado | E04F 11/181 | 256/59 |
| 4,014,520 | A | 3/1977 | Walters | | |
| 4,027,855 | A * | 6/1977 | Lauzier | E04F 11/1844 | 256/65.11 |
| 4,334,671 | A * | 6/1982 | De Guise | E04F 11/181 | 256/65.12 |
| 4,346,872 | A * | 8/1982 | Tornya | E04F 11/181 | 256/65.02 |
| 4,805,879 | A * | 2/1989 | Spera | E04F 11/1844 | 256/65.12 |
| 4,968,005 | A * | 11/1990 | Zen | E04F 11/1836 | 256/65.11 |
| 5,572,845 | A | 11/1996 | Desouza | | |
| 7,438,284 | B2 * | 10/2008 | McGinness | E04F 11/1812 | 256/59 |
| 7,543,802 | B2 * | 6/2009 | Petta | E04F 11/1842 | 256/59 |
| 7,744,065 | B2 * | 6/2010 | Terrels | E04F 11/1844 | 256/59 |
| 8,317,164 | B2 * | 11/2012 | Ash | E04H 17/1439 | 256/67 |
| 8,695,948 | B2 * | 4/2014 | Stinson | E04F 11/1817 | 256/65.12 |
| 9,908,207 | B2 * | 3/2018 | Springborn | E04H 17/1417 | |
| 2014/0021423 | A1 * | 1/2014 | Zen | E04F 11/1817 | 256/24 |
| 2015/0300041 | A1 * | 10/2015 | Feeko | E04H 17/1421 | 256/65.12 |
| 2017/0370121 | A1 * | 12/2017 | Lindsay | E04F 11/1817 | |

* cited by examiner

RAILING SYSTEM

FIELD OF THE INVENTION

The present invention relates to railing systems. In particular, the present invention relates to residential outdoor railing systems.

BACKGROUND OF THE INVENTION

Railing systems for any number of outdoor applications are well known. For example, residential decks, pool decks, and playgrounds all utilize any number of conventional railing systems. Such railing systems typically comprise top and bottom rails, with a number of pickets spanning between the rails.

However, conventional railing systems are often difficult to install, requiring the use of numerous mechanical connectors and tools. There is therefore a need for a railing system that is easy to install and yet physically secure.

SUMMARY OF THE INVENTION

In one aspect of the invention, a rail for a railing system with pickets comprises an elongated cover portion and an elongated side portion. The cover portion comprises an elongated top surface, one or more first connectors proximate to a lateral end of the top surface, a plurality of shelves interspersed between successive ones of the pickets, and one or more second connectors. Each of the shelves comprises a first end, and each of the second connectors extends from at least some of the first ends. The elongated side portion comprises one or more third connectors and one or more fourth connectors. The third connectors are adapted to engage with the one or more first connectors, and the fourth connectors are adapted to engage with the one or more second connectors. The side portion is secured to the cover portion by engagement of the third connectors with the first connectors and by engagement of the fourth connectors with the second connectors.

In another aspect of the invention, the first connectors comprise a U-shaped channel, and the third connectors comprise a protrusion.

In still another aspect of the invention, the engagement of the third connectors with the first connectors comprises the protrusion engaging the U-shaped channel.

In a further aspect, the second connectors comprise a bent edge and the fourth connectors comprise a slot.

In still a further aspect, the engagement of the fourth connectors with the second connectors comprises the bent edge engaging the slot.

In yet still a further aspect, the rail further comprises one or more dampeners. The dampeners are in contact with the pickets and with a surface of the side portion when the side portion is secured to the cover portion.

In another aspect, the side portion further comprises one or more dampener retainers for attaching the dampeners to the side portion.

In a further aspect, the cover portion further comprises a first wall extending generally downwardly from the top surface.

In yet a further aspect, the cover portion further comprises a ledge extending from the first wall, and the shelves extend from the ledge.

In still a further aspect, the ledge engages with the pickets when the side portion is secured to the cover portion.

In another aspect, the shelves extend from the first wall.

In a further aspect, the cover portion further comprises one or more elongated first accessory attachment portions proximate to the first wall.

In yet a further aspect, the first accessory attachment portions comprise a first pair of opposed retaining walls and one or more ridges formed on one or both of the first pair of opposed retaining walls.

In still yet a further aspect, the side portion further comprises a side wall proximate to the third connection member.

In yet another aspect, the side portion further comprises one or more elongated second accessory attachment portions proximate to the side wall.

In still yet another aspect, the second accessory attachment portions comprise a second pair of opposed retaining walls and one or more ridges formed on one or both of the second pair of opposed retaining walls.

In another aspect of the invention, a lower rail for a railing system with pickets comprises an elongated lower cover portion and an elongated lower side portion. The lower cover portion comprises a plurality of lower shelves interspersed between successive ones of the pickets, one or more lower first connectors, an elongated lower bottom surface, and one or more lower second connectors. Each of the lower shelves comprise a first lower end, and each of the lower first connectors extend from at least some of the lower first ends. The lower second connectors are proximate to a lateral end of the lower bottom surface. The lower side portion comprises one or more lower third connectors and one or more lower fourth connectors. The lower third connectors are adapted to engage with the one or more lower first connectors. The lower fourth connectors are adapted to engage with the one or more lower second connectors. The lower side portion is secured to the lower cover portion by engagement of the lower third connectors with the lower first connectors and by engagement of the lower fourth connectors with the lower second connectors.

In a further aspect, the lower first connectors comprise a rounded slot, and the lower third connectors comprise a hooked edge.

In still a further aspect, the engagement of the lower third connectors with the lower first connectors comprises the hooked edge engaging the rounded slot.

In yet still a further aspect, the lower second connectors comprise a slanted edge, and the lower fourth connectors comprise a protrusion.

In a further aspect, the engagement of the lower fourth connectors with the lower second connectors comprises the protrusion engaging the slanted edge.

In a still further aspect, the lower rail further comprises one or more dampeners. The dampeners are in contact with the pickets and with a surface of the lower side portion when the lower side portion is secured to the lower cover portion.

In yet another aspect, the lower side portion further comprises one or more dampener retainers for attaching said dampeners to the lower side portion.

In still another aspect, the lower cover portion further comprises a first wall extending generally downwardly from the lower shelves.

In a further aspect, the lower cover portion further comprises a ledge extending from the first wall.

In a still further aspect, the ledge engages with the pickets when the lower side portion is secured to the lower cover portion.

In yet another aspect, the lower rail further comprises a base portion. The base portion engages with the lower bottom surface.

In another aspect, a railing system comprises a plurality of pickets, the rail described above, and the lower rail described above.

In yet another aspect, the railing system further comprises first and second posts, upper brackets for attaching the rail to the first and second posts, and lower brackets for attaching the lower rail to the first and second posts.

In a further aspect, the railing system further comprises a middle rail interposed between the rail and the lower rail. The middle rail comprises a plurality of openings, with the pickets extending through the openings.

In yet a further aspect, the railing system further comprises middle brackets for attaching the middle rail to the first and second posts.

The foregoing was intended as a summary only and of only some of the aspects of the invention. It was not intended to define the limits or requirements of the invention. Other aspects of the invention will be appreciated by reference to the detailed description of the preferred embodiments. Moreover, this summary should be read as though the claims were incorporated herein for completeness.

BRIEF DESCRIPTION OF THE DRAWINGS

The preferred embodiment of the invention will be described by reference to the drawings thereof, in which.

DETAILED DESCRIPTION

Figure 1:
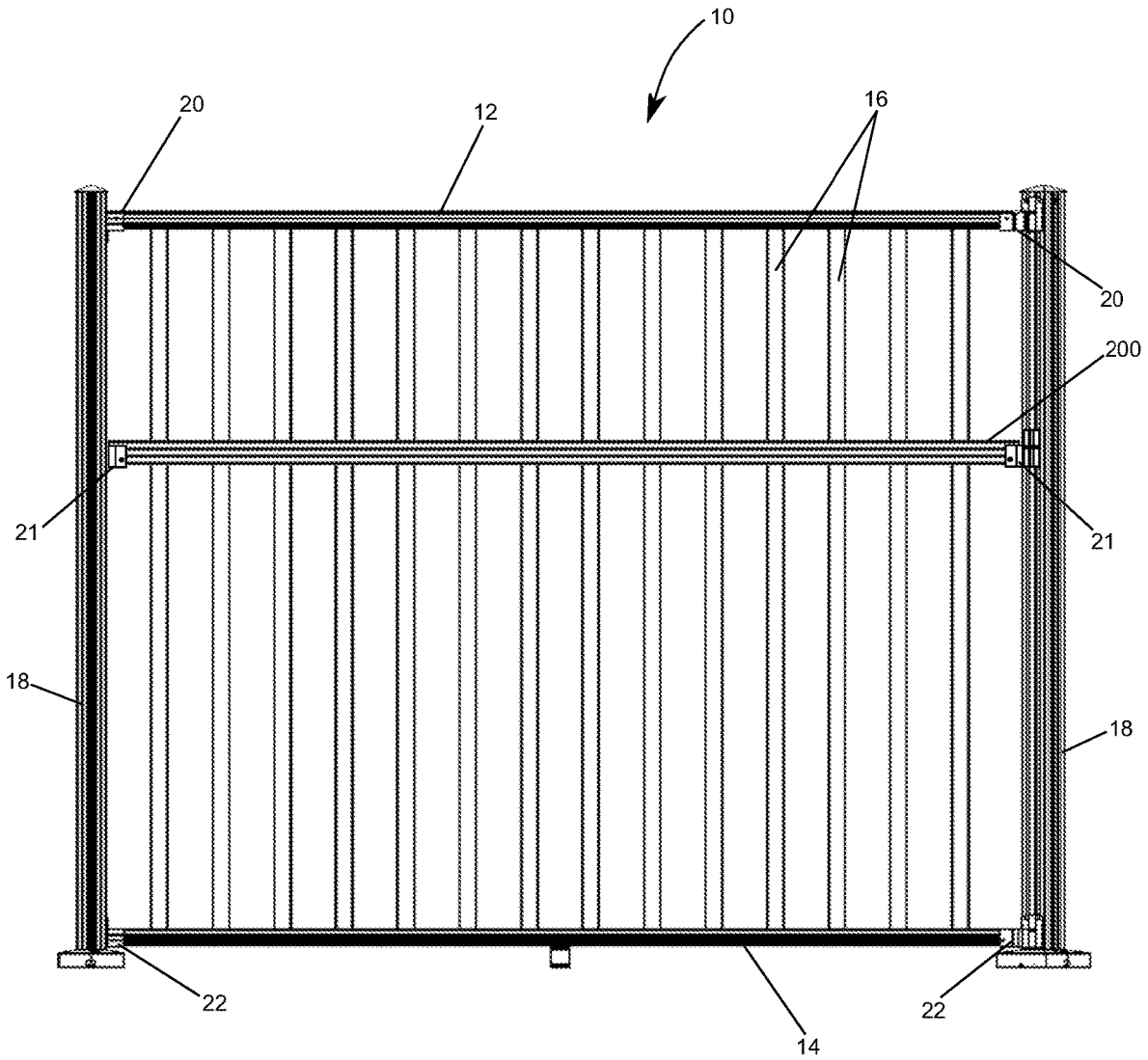
FIG. 1 shows the railing system in accordance with the invention.

Referring to FIG. 1, a railing system 10 in accordance with the present invention is generally shown comprising an elongated upper rail 12, an elongated lower rail 14, and a plurality of pickets 16. The pickets 16 engage with the upper rail 12 and the lower rail 14 in the manner described further below. The upper rail 12 is attached to vertical posts 18 through upper brackets 20, while the lower rail 14 is attached to the posts 18 through lower brackets 22.

Figure 2:
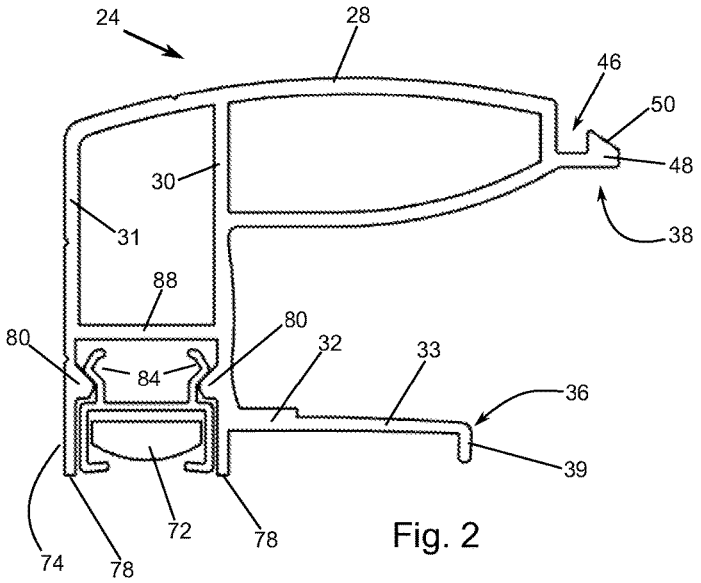
FIG. 2 is a cross-sectional view of the cover portion, taken along plane A in FIG. 1.
Figure 3:
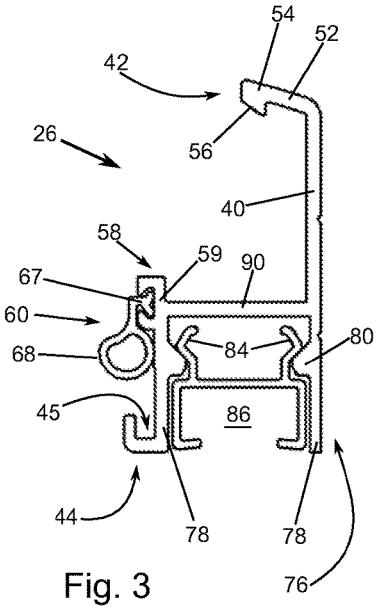
FIG. 3 is a cross-section view of the side portion, taken along plane A in FIG. 1.
Figure 16:
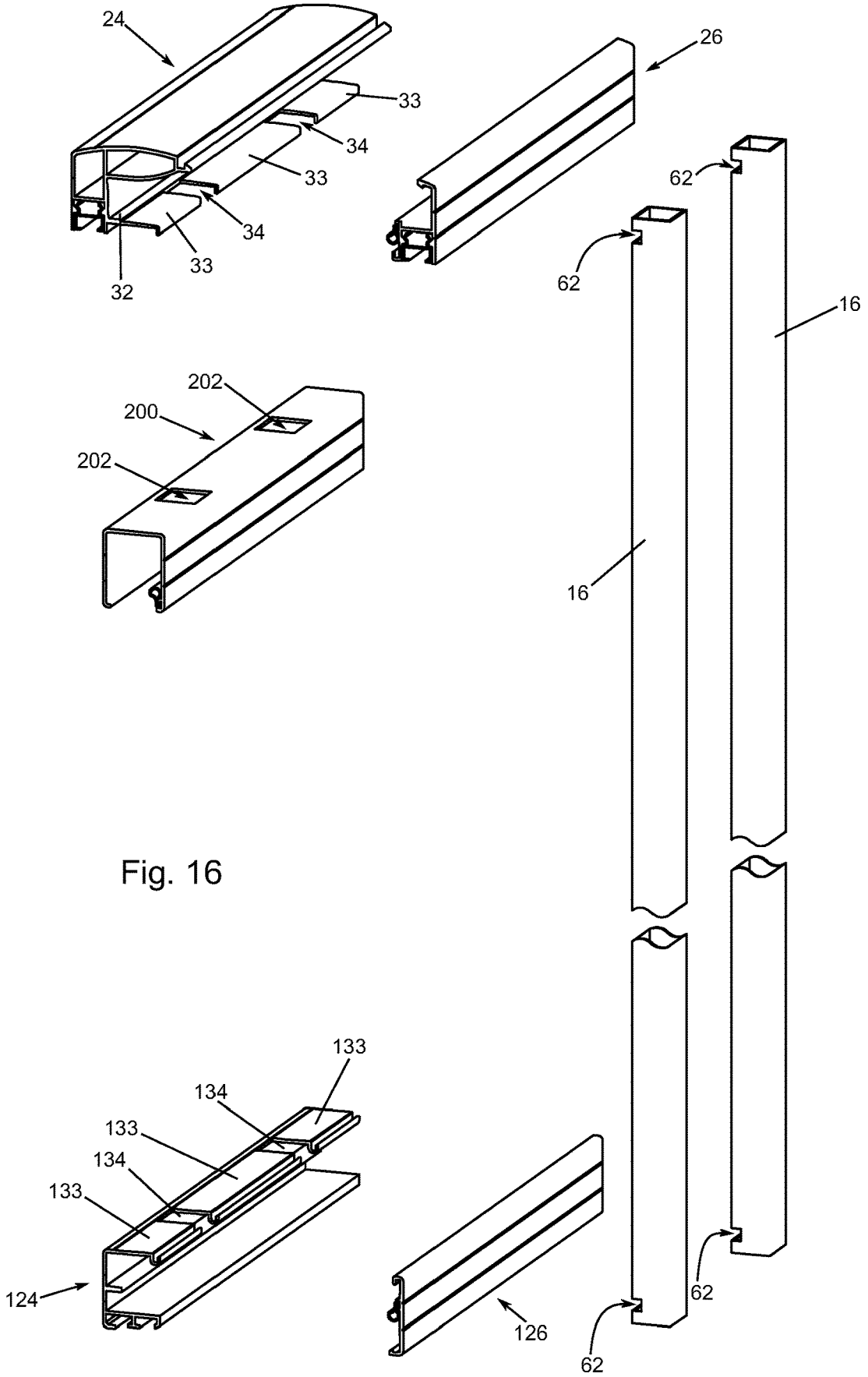
FIG. 16 is an exploded view of the railing system.

Referring to FIGS. 2, 3, and 16, the upper rail 12 comprises an elongated cover portion 24 and an elongated side portion 26. The cover portion 24 comprises a top surface 28 and one or more first connectors 38 that lie proximate to one lateral end of the top surface 28. The top surface 28 may be curved or contoured to facilitate gripping by the user. Preferably, there is a single elongated first connector 38 that extends for substantially the entire length of the cover portion 24; however, in other embodiments, there may be a number of first connectors 38 spaced apart along at least a portion of the length of the cover portion 24. The first connector 38 preferably comprises a U-shaped channel 46. An enlarged tip 48 with a slanted first edge 50 forms one side of the channel 46.

A first wall 30 extends downwardly from the top surface 28. A ledge 32 extends from the first wall 30. Preferably, the ledge 32 extends substantially normal to the first wall 30. As best seen in FIG. 16, a plurality of shelves 33 are spaced apart from each other and extend from the ledge 32. As a result of the spaced arrangement of the shelves 33, a number of gaps 34 are formed between the shelves 33. The ledge 32 lies on one end of the gaps 34, with the other end of the gaps 34 being open. The gaps 34 are sized to be at least as wide as the pickets 16 and preferably approximately the same width as the pickets 16.

In another embodiment, the ledge 32 may be omitted. In this embodiment, the shelves 33 would extend directly from the first wall 30.

At least some of the shelves 33 comprise second connectors 36. Preferably, the second connectors 36 are located proximate to one end of the shelves 33. In the embodiment shown in FIG. 2, the second connectors 36 comprise a bent edge 39. In other embodiments, the second connectors 36 may comprise a claw, a hook, or another suitable connection mechanism.

Referring to FIG. 3, the side portion 26 comprises a side wall 40 and one or more third connectors 42 that engage with the first connectors 38. Preferably, there is a single elongated third connector 42 that extends for substantially the entire length of the side portion 26; however, in other embodiments, there may be a number of third connectors 42 spaced apart along at least a portion of the length of the side portion 26. The third connectors 42 preferably comprises an elongated arm 52 extending from the side wall 40, with an elongated protrusion 54 on one end of the arm 52. The protrusion 54 preferably comprises a slanted second edge 56.

The side portion 26 also comprises one or more fourth connectors 44 that engage with the second connectors 36.

Preferably, there is a single elongated fourth connector 44 that extends for substantially the entire length of the side portion 26; however, in other embodiments, there may be a number of fourth connectors 44 spaced apart along at least a portion of the length of the side portion 26. The fourth connector 44 preferably comprises an elongated slot 45.

Figure 9:
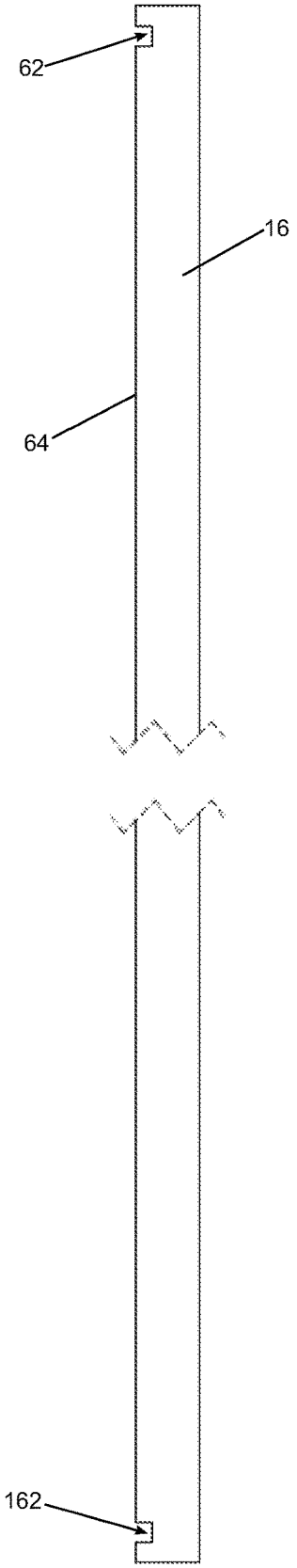
FIG. 9 is a cross-sectional view of the picket, taken along plane E in FIG. 1.
Figure 10:
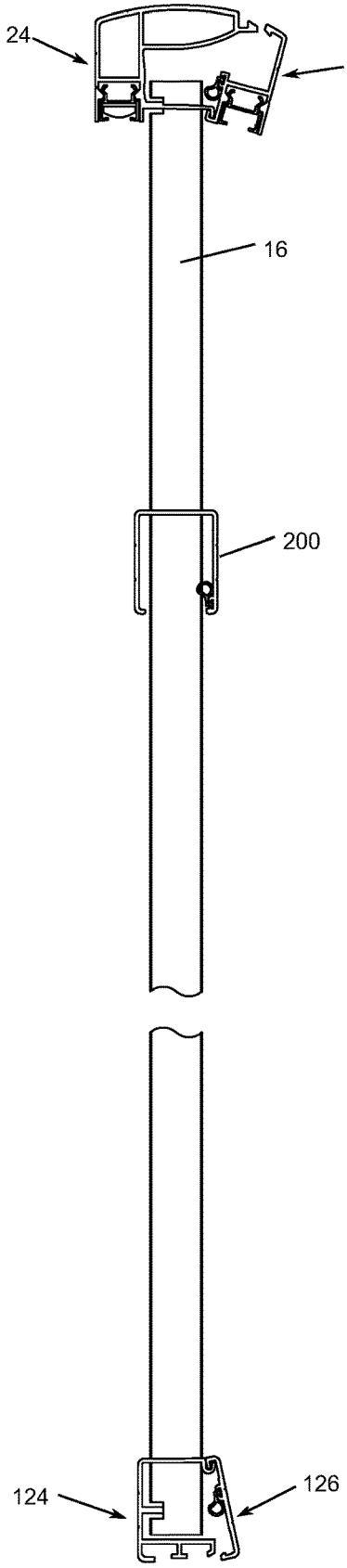
FIG. 10 is a cross-sectional view showing the beginning of the attachment of the side portion to the cover portion and the lower side portion to the lower cover portion.
Figure 11:
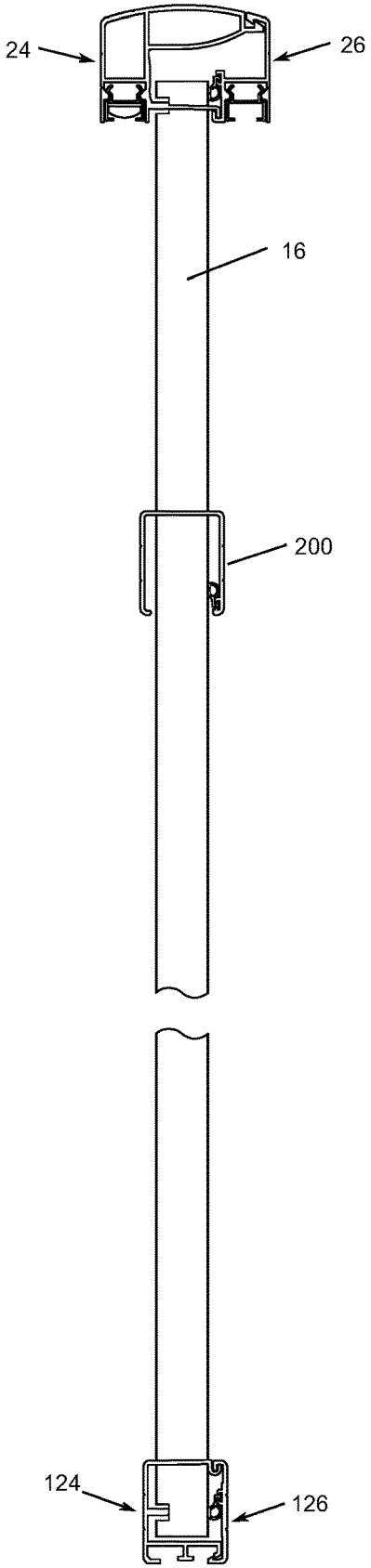
FIG. 11 is a cross-sectional view showing the attachment of the side portion to the cover portion and the lower side portion to the lower cover portion.

Referring to FIGS. 9 and 16, the pickets 16 are preferably tubular, with a rectangular cross-section. A slit 62 is formed on one face 64 of each of the pickets 16. The slit 62 preferably extends for the entire width of the picket 16 and is at least as thick as the thickness of the ledge 32. In cases where the picket 16 is tubular, the slit 62 may extend through the wall that forms the face 64. The location of the slit 62 on the picket 16 is preferably such that the top portion of the picket 16 is able to fit within the cover portion 24.

Referring to FIGS. 10 to 13, the cover portion 24 is attached to the side portion 26 and the pickets 16 in the following manner. One of the pickets 16 is inserted in each of the gaps 34 (i.e. between the shelves 33), with the side of the picket 16 containing the face 64 facing the ledge 32 of the cover portion 24. The ledge 32 engages with the slit 62 on the picket 16, holding the picket 16 in place against the cover portion 24.

Figure 12:
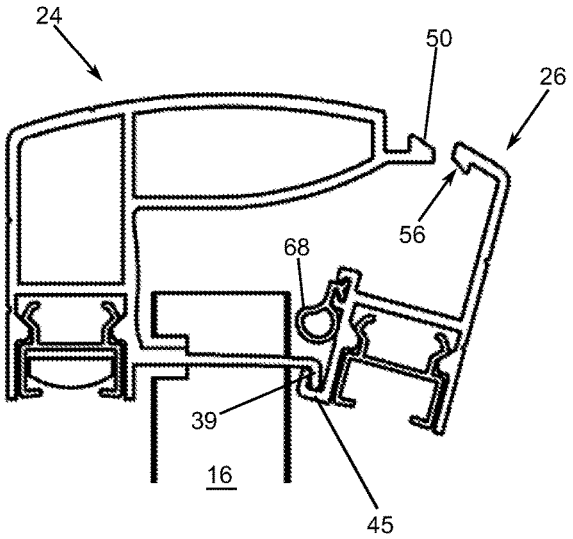
FIG. 12 is an enlarged view of portion F of FIG. 10.

The side portion 26 can then be attached to the cover portion 24. The bent edge 39 (of the second connector 36) is inserted into the slot 45 (of the fourth connector 44) such that the side portion 26 is initially at an angle to the cover portion 26, as shown in FIG. 12. The side portion 26 is then rotated upwards (through rotation of the bent edge 39 within the slot 45) until the protrusion 54 (of the third connector 42) comes into contact with the tip 48 (of the first connector 38).

Figure 13:
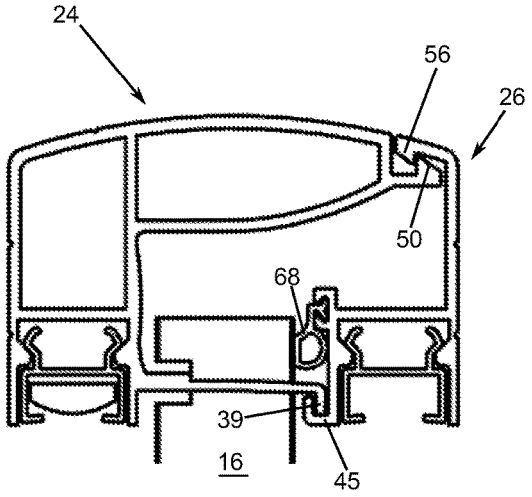
FIG. 13 is an enlarged view of portion G of FIG. 11.

After further force is exerted on the protrusion 54 against the tip 48, the second edge 56 (on the protrusion 54) will slide across the first edge 50 (on the tip 48), at the same time causing the arm 52 to deflect slightly away from the second wall 40. After the second edge 56 has completely passed the first edge 50, the protrusion 54 will fit within the channel 46, and the arm 52 will revert back to its previous orientation (as shown in FIG. 13).

In this manner, the side portion 26 is now held in place against the cover portion 24 by both (1) the interaction of the bent edge 39 and the slot 45; and (2) the interaction of the protrusion 54 and the channel 46. Preferably, when the cover portion 24 is attached to the side portion 26, the arm 52 forms a generally continuous surface with the top surface 28. In addition, the pickets 16 will be held in place laterally by the gaps 34 and will be prevented from moving vertically by the ledge 32 engaging the slit 62.

Alternatively, instead of the cover portion 24 having a plurality of shelves 33, there may be a single shelf member 33, but with cutouts or openings corresponding approximately to the location and circumference of the pickets 16. In such an embodiment, instead of the pickets 16 being inserted in the gaps 34 between shelves 33, the pickets 16 would instead be inserted through the cutouts or openings.

The upper rail 12 preferably comprises one or more dampeners 60. Preferably, there is a single elongated dampener 60 that extends for substantially the entire length of the upper rail 12; however, in other embodiments, there may be a number of dampeners 60 spaced apart along at least a portion of the length of the upper rail 12. The dampener 60 comprises an attachment portion 66 and a bulbous portion 68. The attachment portion 66 may comprise a hook, a bend, a prong, or the like. In the embodiment shown in FIG. 3, the attachment portion 66 comprises a Y-shaped prong 67.

Preferably, the side portion 26 comprises one or more dampener retainers 58. The dampener retainers 58 engage the dampeners 60 (as described later). There is preferably a single elongated dampener retainer 58 that extends for substantially the entire length of the side portion 26; however, in other embodiments, there may be a number of dampener retainers 58 spaced apart along at least a portion of the length of the side portion 26. The dampener retainer 58 may comprise a socket, a slot, a channel, or the like. In the embodiment shown in FIG. 3, the dampener retainer 58 comprises an elongated socket 59.

The dampener 60 is preferably attached to the dampener retainer 58 before the side portion 26 is attached to the cover portion 24. The dampener 60 is attached by inserting the attachment portion 66 into the dampener retainer 58. In the embodiment shown in FIG. 13, where the attachment portion 66 comprises a prong 67 and the dampener retainer 58 comprises a socket 59, the attachment portion 66 may be inserted into the dampener retainer 58 by slightly compressing the ends of the prong 67 until the prong 67 fits within the opening of the socket 59. Alternatively, the prong 67 may be inserted by laterally sliding one end of the prong 67 through an open end of the socket 59. As shown in FIG. 13, when the dampener 60 is attached to the side portion 26, the bulbous portion 68 hangs downwardly from the dampener retainer 58. When the side portion 26 is later attached to the cover portion 24, the bulbous portion 68 comes into contact with, and acts as a buffer or cushion between, both the side portion 26 and the picket 16. In this manner, any unwanted "wobble" or movement of the upper rail 12 with respect to the picket 16 is reduced.

Preferably, the bulbous portion 68 is made of a softer or more pliable material than the other portions of the dampeners 60. As a result, when the side portion 26 is attached to the cover portion 24 and the bulbous portion 68 acts as a buffer between the side portion 26 and the picket 16, the bulbous portion 68 may deform slightly (as shown in FIG. 13).

Referring to FIGS. 2 and 3, the upper rail 12 may accommodate one or more accessories 72, such as illuminated strips, hooks, hangers, or decorative pieces. In the embodiment shown in FIGS. 2 and 3, the cover portion 24 comprises a first accessory attachment portion 74 proximate to the first wall 30, while the side portion 26 comprises a second accessory attachment portion 76 proximate to the second wall 40. In this manner, when the cover portion 24 is attached to the pickets 16 and the side portion 26, the first accessory attachment portion 74 and the second accessory attachment portion 76 will lie on opposite sides of the pickets 16.

Preferably, there is a single elongated first accessory attachment portion 74 and a single elongated second accessory attachment portion 76 extending for substantially the entire lengths of the cover portion 24 and the side portion 26, respectively; however, in other embodiments, there may be a number of first accessory attachment portions 74 and second accessory attachment portions 76 spaced apart along at least a portion of the lengths of the cover portion 24 and the side portion 26, respectively.

Preferably, the accessory attachment portions 74, 76 each comprises a pair of opposed retaining walls 78. The retaining walls 78 may comprise ridges 80 that serve to secure one or more accessories 72. For example, in the embodiment shown in FIGS. 2 and 3, the accessories 72 comprise a number of bent sides 84 that engage with the ridges 80. The accessories 72 may further comprise compartments 86 for holding the other items (e.g. an illuminated strip as shown in FIG. 2).

Preferably, as shown in FIG. 2, the cover portion 24 further comprises a second wall 31 that extends downwardly from the top surface 28. Furthermore, a first surface 88 preferably spans the first and second walls 30, 31, with the retaining walls 78 extending downwardly from the first surface 88.

As shown in FIG. 3, the side portion 26 preferably comprises a second surface 90 extending from the side wall 40. The retaining walls 78 preferably extend downwardly from the second surface 90.

Figure 4:
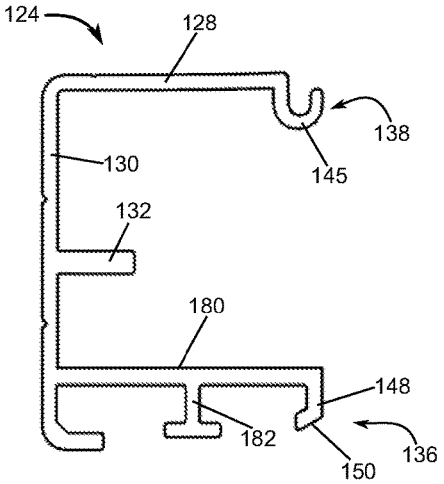
FIG. 4 is a cross-sectional view of lower cover portion, taken along plane B in FIG. 1.
Figure 5:
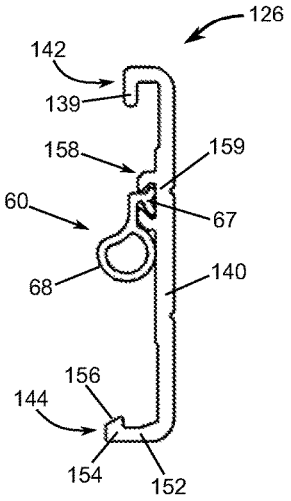
FIG. 5 is a cross-sectional view of the lower side portion, taken along plane B in FIG. 1.

Referring to FIGS. 4, 5, and 16, the lower rail 14 comprises an elongated lower cover portion 124 and an elongated lower side portion 126. The lower cover portion 124 comprises a lower top surface 128, an opposed lower bottom surface 180, with a lower first wall 130 that extends generally between the two surfaces 128, 180. A lower ledge 132 extends from the lower first wall 130, preferably at a distance spaced apart from both the lower top surface 128 and the lower bottom surface 180.

The lower bottom surface 180 preferably comprises one or more lower attachment portions 182 and one or more lower second connectors 136. Preferably, there is a single elongated lower attachment portion 182 and a single elongated lower second connector 136 that both extend for substantially the entire length of the lower bottom surface 180; however, in other embodiments, there may be a number of lower attachment portions 182 and/or lower second connectors 136 spaced apart along at least a portion of the length of the lower bottom surface 180. In the embodiment shown in FIG. 4, the lower attachment portion 182 comprises an inverted "T", while the lower second connector 136 comprises a lower tip 148 with a slanted lower first edge 150. However, in other embodiments, the lower attachment portion 182 and the lower second connector 136 may comprise other configurations (e.g. hooks, claws, etc.).

The lower top surface 128 preferably comprises a plurality of lower shelves 133 spaced apart from one another, forming a plurality of lower gaps 134 in between the spaced lower shelves 133. The lower gaps 134 are sized to be at least as wide as the pickets 16 and preferably approximately the same width as the pickets 16. At least some of the lower shelves 133 comprise a lower first connector 138. In the embodiment shown in FIG. 4, the lower first connector 138 comprises a rounded lower slot 145.

Figure 6:
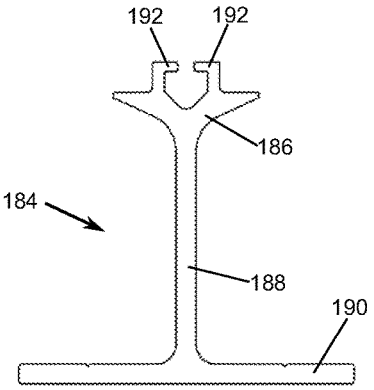
FIG. 6 if a cross-sectional view of the base portion, taken along plane C in FIG. 1.
Figure 7:
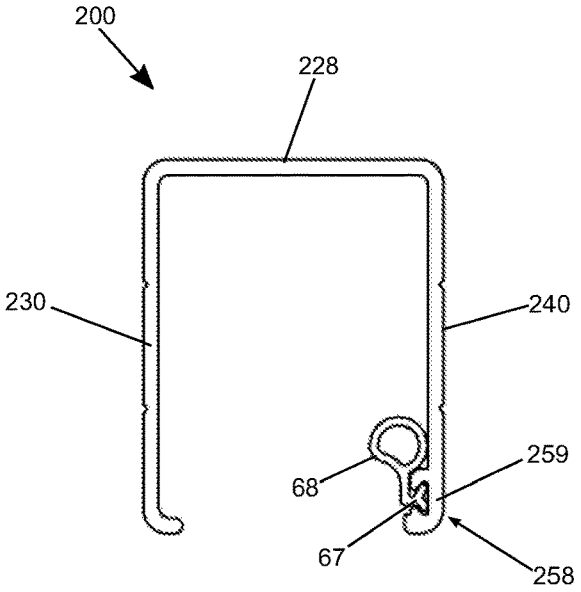
FIG. 7 is a cross-sectional view of the middle rail, taken along plane D in FIG. 1.

The lower attachment portion 182 engages with a base 184 that supports the lower rail 14. In the embodiment shown in FIG. 6, the base 184 comprises a base attachment portion 186 and a support base 190, with a generally vertical support member 188 spanning the two. The base attachment portion 186 comprises opposed gripping portions 192 that fit around the lower attachment portion 182 and hold the lower cover portion 124 in place. The support base 190 preferably lies on the ground and supports the support member 188.

Referring to FIG. 5, the lower side portion 126 comprises a lower second wall 140. The lower side portion 126 further comprises one or more lower third connectors 142 that engage with the lower first connectors 138. Preferably, there is a single elongated lower third connector 142 that extends for substantially the entire length of the lower side portion 126; however, in other embodiments, there may be a number of lower third connectors 142 spaced apart along at least a portion of the length of the lower side portion 126. The lower third connector 142 preferably comprises a hooked edge 139.

The lower side portion 126 also comprises one or more lower fourth connectors 144 that engage with the lower second connector 136. Preferably, there is a single elongated fourth connector 144 that extends for substantially the entire length of the lower side portion 126; however, in other embodiments, there may be a number of lower fourth connectors 144 spaced apart along at least a portion of the length of the lower side portion 26. The lower fourth connector 144 preferably comprises an elongated lower arm 152 extending from the lower second wall 140, with an elongated lower protrusion 154 on one end of the lower arm 152. The lower protrusion 154 comprises a slanted lower second edge 156.

Referring to FIGS. 10, 11, 14, and 15, the lower cover portion 124 is attached to the lower side portion 126 and the pickets 16 in the following manner. One of the pickets 16 is inserted in each of the lower gaps 134 (i.e. between the lower shelves 133), with the side of the picket 16 containing the face 64 facing the lower ledge 132 of the lower cover portion 124. The lower ledge 132 engages with a lower slit 162 on the picket 16, holding the picket 16 in place against the lower cover portion 124.

The lower slit 162 is formed on the face 64 (i.e. on the same surface of the picket 16 as slit 62). The lower slit 162 preferably extends for the entire width of the picket 16 and is at least as thick as the thickness of the lower ledge 132. As with the slit 62, the lower slit 162 may extend through the wall that forms the face 64. The location of the lower slit 162 on the picket 16 is preferably such that the vertical distance between the lower slit 162 and the bottom of the picket 16 is less than the vertical distance between lower ledge 132 and the lower bottom surface 180. This allows the bottom portion of the picket 16 to be placed within the lower cover portion 124.

Figure 14:
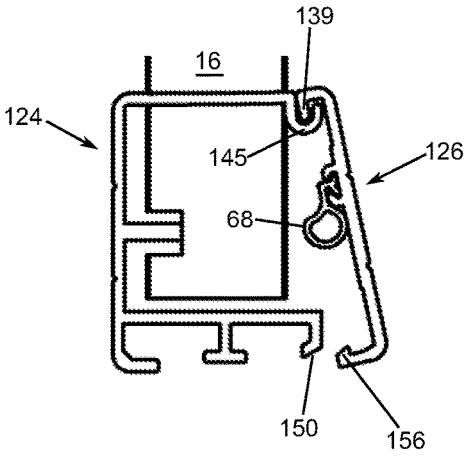
FIG. 14 is an enlarged view of portion H of FIG. 10.
Figure 15:
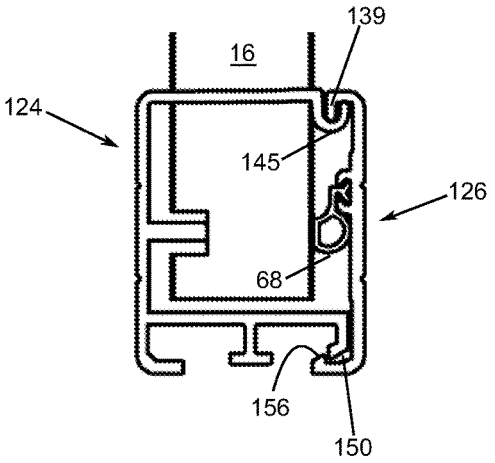
FIG. 15 is an enlarged view of portion I of FIG. 11.

The lower side portion 126 can then be attached to the lower cover portion 124. The hooked edge 139 (of the lower third connector) is inserted into the lower slot 145 (of the lower first connector) such that the lower side portion 126 is initially at an angle to the lower cover portion 126, as shown in FIG. 14. The lower side portion 126 is then rotated downwards (through rotation of the hooked edge 139 within the lower slot 145) until the lower protrusion 154 (of the lower fourth connector) comes into contact with the lower tip 148 (of the lower second connector). After further force is exerted on the lower protrusion 154 against the lower tip 148, the lower second edge 156 (on the lower protrusion 154) will slide across the lower first edge 150 (on the lower tip 148), at the same time causing the lower arm 152 to deflect slightly away from the lower second wall 140. After the lower second edge 156 has completely passed the lower first edge 150, the lower arm 152 will revert back to its previous orientation (as shown in FIG. 15), and the lower protrusion 154 will be held against the lower tip 148.

In this manner, the lower side portion 126 is now held in place against the lower cover portion 124 by both (1) the interaction of the hooked edge 139 and the lower slot 145; and (2) the interaction of the lower protrusion 154 and the lower tip 148. In addition, the pickets 16 will be held in place laterally by the lower gaps 134 and will be prevented from moving vertically by the lower ledge 132 engaging the lower slit 162.

Alternatively, instead of the lower cover portion 124 having a plurality of lower shelves 133, there may be a single lower shelf 133, but with cutouts or openings corresponding approximately to the location and circumference of the pickets 16. In this embodiment, instead of the pickets 16 being inserted in the lower gaps 34 between the lower shelves 133, the pickets 16 would instead be inserted through the cutouts or openings.

As with the upper rail 12, the lower rail 14 preferably also comprises one or more dampeners 60. There may be a single elongated dampener 60 that extends for substantially the entire length of the lower rail 14, or there may be a number of dampeners 60 spaced apart along at least a portion of the length of the lower rail 14.

Preferably, the lower side portion 126 comprises one or more lower dampener retainers 158 to engage the dampeners 60. There is preferably a single elongated lower dampener retainer 158 that extends for substantially the entire length of the lower side portion 126; however, in other embodiments, there may be a number of lower dampener retainers 158 spaced apart along at least a portion of the length of the lower side portion 126. In the embodiment shown in FIG. 5, the lower dampener retainer 158 comprises an elongated lower socket 159 extending from the lower second wall 140.

The dampener 60 is preferably attached to the lower dampener retainer 158 before the lower side portion 126 is attached to the lower cover portion 124. The dampener 60 is attached by inserting the attachment portion 66 into the lower dampener retainer 158. In the embodiment shown in FIG. 15, the attachment portion 66 may be inserted into the lower dampener retainer 158 by slightly compressing the tines 70 of the prong 67 until the prong 67 fits within the opening of the lower socket 159. Alternatively, the prong 67 may be inserted by laterally sliding one end of the prong 67 through an open end of the lower socket 159. As shown in FIG. 15, when the dampener 60 is attached to the lower side portion 126, the bulbous portion 68 hangs downwardly from the lower dampener retainer 158. When the lower side portion 126 is later attached to the lower cover portion 124, the bulbous portion 68 comes into contact with, and acts as a buffer or cushion between, both the lower side portion 126 and the picket 16, reducing any unwanted "wobble" or movement of the lower rail 14 with respect to the picket 16.

When the lower side portion 126 is attached to the lower cover portion 124 and the bulbous portion 68 acts as a buffer between the lower side portion 126 and the picket 16, the bulbous portion 68 may deform slightly (as shown in FIG. 15).

Figure 8:
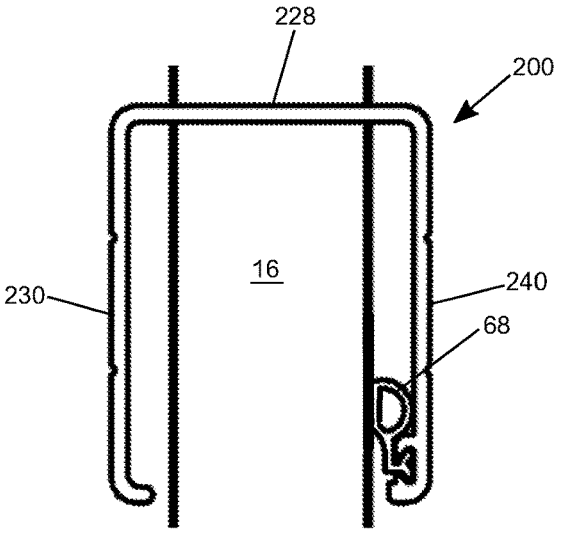
FIG. 8 is a cross-sectional view of the middle rail and picket, taken along plane D in FIG. 1.

The railing system 10 may further comprise a middle rail 200 that lies between the upper rail 12 and the lower rail 14. The middle rail 200 comprises opposed middle first wall 230 and middle second wall 240, with a middle top surface 228 extending between the two. The middle top surface 228 comprises a number of openings 202. The openings 202 correspond approximately in size and location to the pickets 16. In other words, the pickets 16 pass through the openings 202, as shown in FIG. 8.

The middle rail 200 may be attached to the vertical posts 18 using middle brackets 21.

The middle second wall 240 preferably comprises one or more middle dampener retainers 258 to engage the dampeners 60. There is preferably a single elongated middle dampener retainer 258 that extends for substantially the entire length of the middle rail 200; however, in other embodiments, there may be a number of middle dampener retainers 258 spaced apart along at least a portion of the length of the middle rail 200. In the embodiment shown in FIG. 8, the middle dampener retainer 258 comprises an elongated middle socket 259 extending from the middle second wall 240.

The dampener 60 is preferably attached to the middle dampener retainer 258 by inserting the attachment portion 66 into the middle dampener retainer 258. In the embodiment shown in FIG. 8, the attachment portion 66 may be inserted into the middle dampener retainer 258 by slightly compressing the tines 70 of the prong 67 until the prong 67 fits within the opening of the middle socket 259. Alternatively, the prong 67 may be inserted by laterally sliding one end of the prong 67 through an open end of the middle socket 259. As shown in FIG. 8, when the dampener 60 is attached, the bulbous portion 68 hangs downwardly from the middle dampener retainer 258. The bulbous portion 68 comes into contact with, and acts as a buffer or cushion between, both the middle second wall 240 and the picket 16, reducing any unwanted "wobble" or movement of the middle rail 200 with respect to the picket 16. When the bulbous portion 68 acts as a buffer between the middle second wall 240 and the picket 16, the bulbous portion 68 may deform slightly (as shown in FIG. 8).

Figure 17:
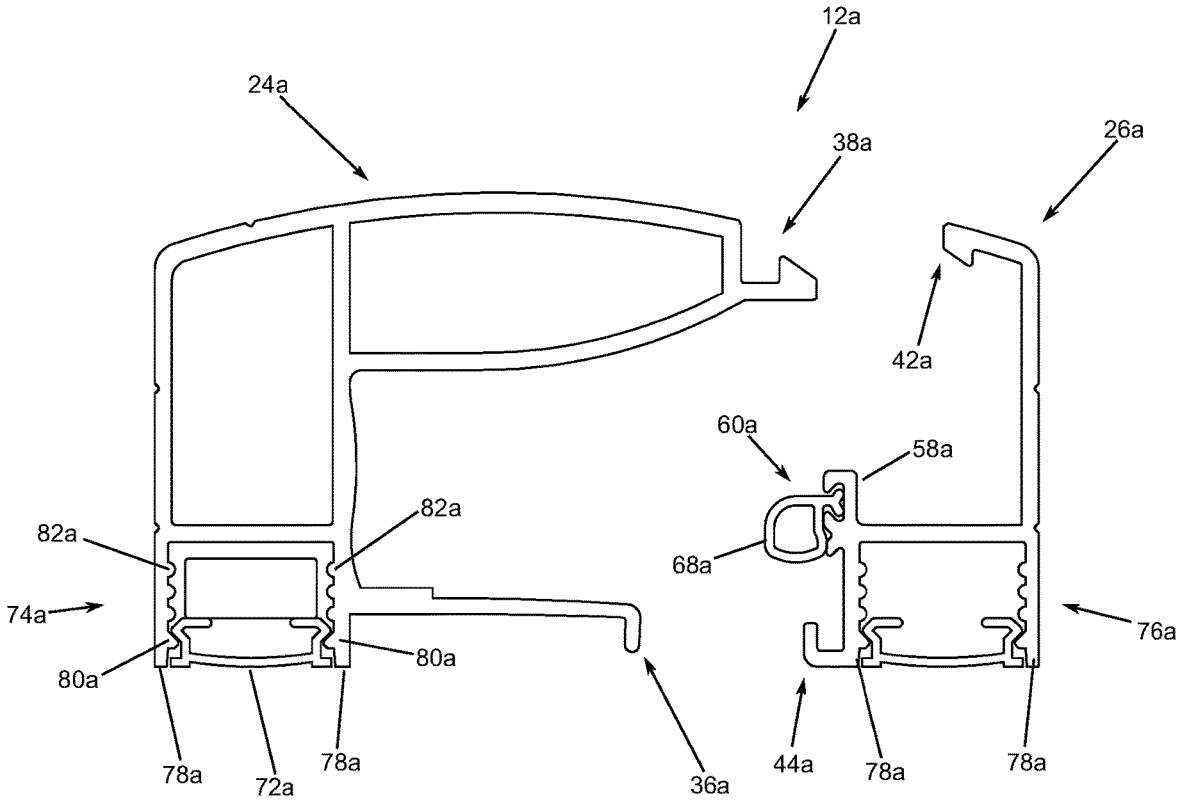
FIG. 17 is a cross-sectional view showing an alternative embodiment of the upper rail, with the cover portion detached from the side portion.
Figure 18:
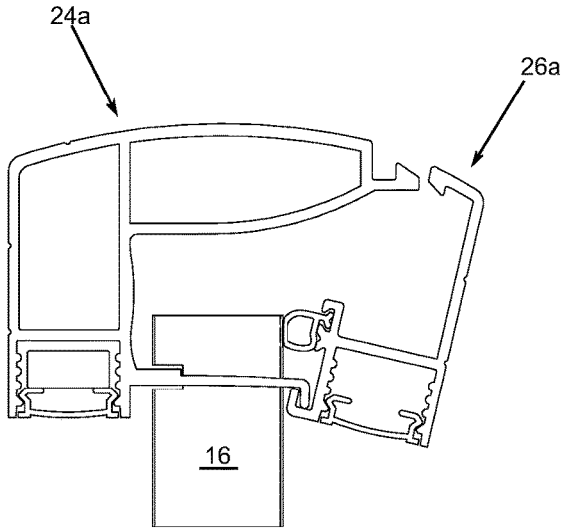
FIG. 18 is a cross-sectional view of the upper rail of FIG. 17, with the cover portion placed about a picket and the side portion partially attached to the cover portion.
Figure 19:
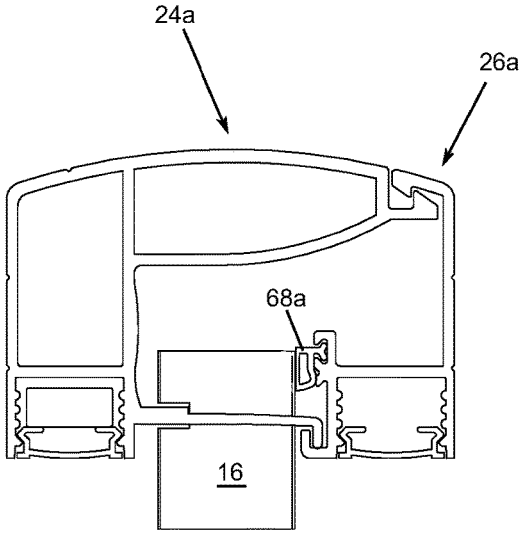
FIG. 19 is a cross-sectional view of the upper rail of FIG. 17, with the cover portion placed about a picket and the side portion attached to the cover portion.
Figure 20:
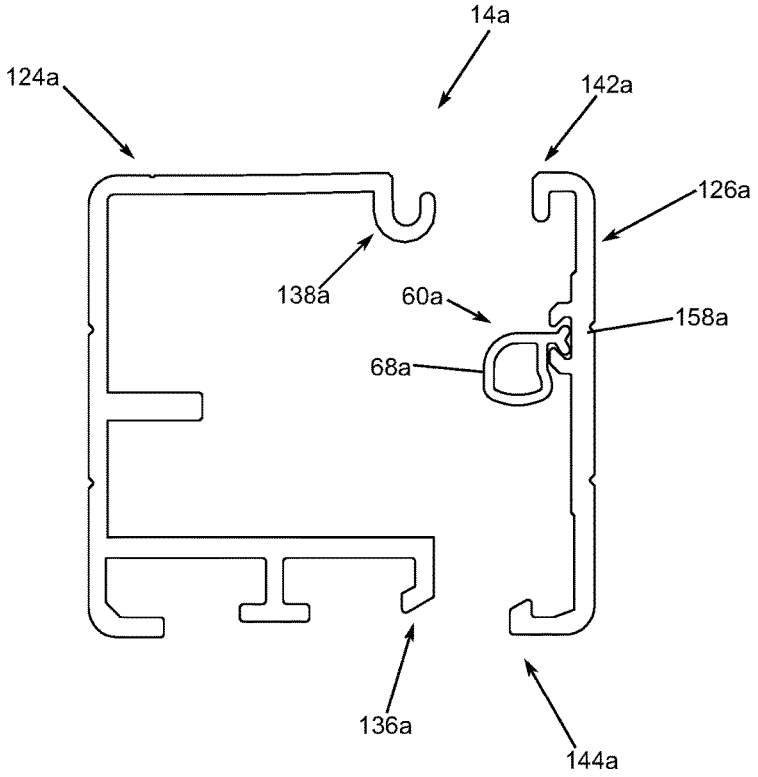
FIG. 20 is a cross-sectional view showing an alternative embodiment of the lower rail, with the lower cover portion detached from the lower side portion.
Figure 21:
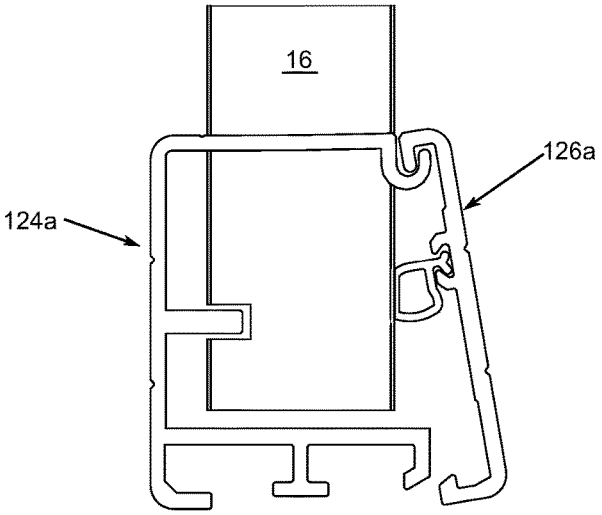
FIG. 21 is a cross-sectional view of the lower rail of FIG. 20, with the lower cover portion placed about a picket and the lower side portion partially attached to the lower cover portion.
Figure 22:
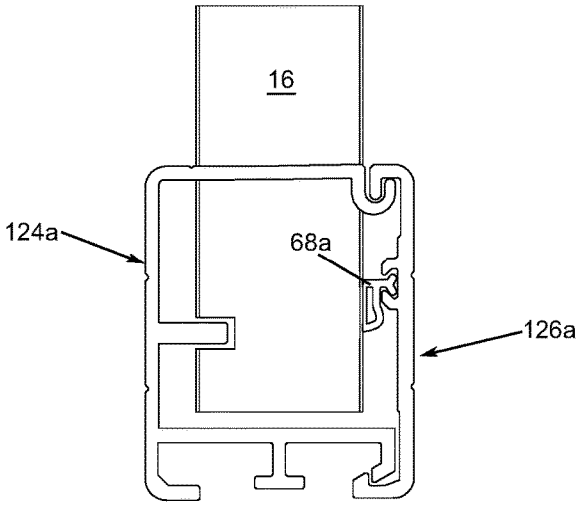
FIG. 22 is a cross-sectional view of the lower rail of FIG. 20, with the lower cover portion placed about a picket and the lower side portion attached to the lower cover portion.

FIGS. 17 to 19 show an alternative embodiment for the upper rail 12*a*, while FIGS. 20 to 22 show an alternative embodiment for the lower rail 14*a*.

Referring to FIG. 17, the upper rail 12*a* also comprises an elongated cover portion 24*a* and an elongated side portion 26*a*. Attachment of the cover portion 24*a* to the side portion 26*a* is also effected by the engagement of a first connector 38*a* on the cover portion 24*a* with a third connector 42*a* on the side portion 26*a*, and by engagement of a second connector 36*a* on the cover portion 24*a* with a fourth connector 44*a* on the side portion 26*a*, as described in detail above for the upper rail 12. A dampener 60*a* is also engaged to a dampener retainer 58*a* on the side portion 26*a*. In this embodiment, the bulbous portion 68*a* of the dampener 60*a* has more of a square cross-sectional shape, as compared to the more rounded shape of the bulbous portion 68 of the previous embodiment. Other suitable shapes for the bulbous portion 68*a* are also possible, such as triangular, rectangular, oval, etc.

Preferably, the bulbous portion 68*a* is made of a softer or more pliable material than the other portions of the dampeners 60*a*. As a result, when the side portion 26*a* is attached to the cover portion 24*a* and the bulbous portion 68*a* acts as a buffer between the side portion 26*a* and the picket 16*a*, the bulbous portion 68*a* may deform slightly (as best seen in FIG. 19).

FIGS. 18 and 19 show the attachment of the cover portion 24*a* to the side portion 26*a* and the picket 16. The mechanism for this attachment is similar to that described above in detail for the upper rail 12.

One other difference between the alternative embodiment shown in FIG. 17 and the previous embodiment is in the first and second accessory attachment portions 74*a*, 76*a*. In this embodiment, the first and second accessory attachment portions 74*a*, 76*a* each comprise a pair of opposed retaining walls 78*a*. Each of the retainer walls 78*a* comprises a ridge 80*a* that serve to secure one or more accessories 72*a* (e.g. a light strip). The accessories 72*a* may comprise one or more bent sides 84*a* that engage with the ridges 80*a* to hold the accessories 72*a* in place with the respective first and second accessory attachment portions 74*a*, 76*a*. One or more projections 82*a* may also be present on the retaining walls 78*a*. These projections 82*a* may assist in holding the accessories 72*a* in place within the first and second accessory attachment portions 74*a*, 76*a*.

In another embodiment, instead of light strips, the first and second accessory attachment portions 74*a*, 76*a* may be adapted to hold other accessories 72*a*. For example, they may be adapted to hold one or more hooks or hangers, including but not limited to flower holders, drink holders, towel hooks, and umbrella holders. These hooks or hangers may be used to hang ornaments or other items from the upper rail 12*a*.

Referring to FIG. 20, the lower rail 14*a* also comprises an elongated lower cover portion 124*a* and an elongated lower side portion 126*a*. Attachment of the lower cover portion 124*a* to the lower side portion 126*a* is also effected by the engagement of a lower first connector 138*a* on the lower cover portion 124*a* with a lower third connector 142*a* on the lower side portion 126*a*, and by engagement of a lower second connector 136*a* on the lower cover portion 124*a* with a lower fourth connector 144*a* on the lower side portion 126*a*, as described in detail above for the lower rail 14. The dampener 60*a* is also engaged to a lower dampener retainer 158*a* on the lower side portion 126*a*. In this embodiment, the bulbous portion 68*a* of the dampener 60*a* has more of a square cross-sectional shape. When the lower side portion 126*a* is attached to the lower cover portion 124*a* and the bulbous portion 68*a* acts as a buffer between the lower side portion 126*a* and the picket 16*a*, the bulbous portion 68*a* may deform slightly (as best seen in FIG. 22).

FIGS. 21 and 22 show the attachment of the lower cover portion 124*a* to the lower side portion 126*a* and the picket 16. The mechanism for this attachment is similar to that described above in detail for the lower rail 14.

It will be appreciated by those skilled in the art that the preferred embodiment has been described in some detail but that certain modifications may be practiced without departing from the principles of the invention.

The invention claimed is:

1. An upper rail for use with a railing system with pickets, said upper rail comprising:
- an elongated cover portion comprising:
  - an elongated top surface;
  - one or more first connectors, wherein said first connectors are proximate to a lateral end of said top surface;
  - a plurality of shelves, wherein at least some of said plurality of shelves extend between successive ones of said pickets of said railing system, each of said shelves comprising a first end; and
  - one or more second connectors, wherein each of said second connectors extends from at least some of said first ends;
- an elongated side portion comprising:
  - one or more third connectors, wherein said third connectors are adapted to engage with said one or more first connectors; and
  - one or more fourth connectors, wherein said fourth connectors are adapted to engage with said one or more second connectors; and
- one or more dampeners, wherein said dampeners are in contact with said pickets of said railing system and with a surface of said side portion when said side portion is secured to said cover portion;
- wherein said side portion is secured to said cover portion by engagement of said third connectors with said first connectors and by engagement of said fourth connectors with said second connectors.

2. The upper rail of claim 1, wherein said first connectors comprise a U-shaped channel, wherein said third connectors comprise a protrusion and wherein said engagement of said third connectors with said first connectors comprises said protrusion engaging said U-shaped channel.

3. The upper rail of claim 1, wherein said second connectors comprise a bent edge, wherein said fourth connectors comprise a slot and wherein said engagement of said fourth connectors with said second connectors comprises said bent edge engaging said slot.

4. The upper rail of claim 1, wherein said side portion further comprises one or more dampener retainers for attaching said dampeners to said side portion.

5. The upper rail of claim 1, wherein said cover portion further comprises a first wall extending generally downwardly from said top surface.

6. The upper rail of claim 5, wherein said cover portion further comprises a ledge extending from said first wall and wherein said shelves extend from said ledge and wherein said ledge engages with said pickets of said railing system when said side portion is secured to said cover portion.

7. The upper rail of claim 5, wherein said shelves extend from said first wall.

8. The upper rail of claim 5, wherein said cover portion further comprises one or more elongated first accessory attachment portions proximate to said first wall.

9. The upper rail of claim 8, wherein said first accessory attachment portions comprise:
- a first pair of opposed retaining walls; and
- one or more ridges formed on one or both of said first pair of opposed retaining walls.

10. The upper rail of claim 1, wherein said side portion further comprises a side wall proximate to said third connection member.

11. The upper rail of claim 10, wherein said side portion further comprises one or more elongated second accessory attachment portions proximate to said side wall.

12. The upper rail of claim 11, wherein said second accessory attachment portions comprise:
- a second pair of opposed retaining walls; and
- one or more ridges formed on one or both of said second pair of opposed retaining walls.

13. A lower rail for use with a railing system with pickets, said lower rail comprising:
- an elongated lower cover portion comprising:
  - a plurality of lower shelves, wherein at least some of said lower shelves extend between successive ones of said pickets of said railing system, each of said lower shelves comprising a first lower end;
  - one or more lower first connectors, wherein each of said lower first connectors extend from at least some of said lower first ends;
  - an elongated lower bottom surface; and
  - one or more lower second connectors, wherein said lower second connectors are proximate to a lateral end of said lower bottom surface;
- an elongated lower side portion comprising:
  - one or more lower third connectors, wherein said lower third connectors are adapted to engage with said one or more lower first connectors; and
  - one or more lower fourth connectors, wherein said lower fourth connectors are adapted to engage with said one or more lower second connectors; and
- one or more dampeners, wherein said dampeners are in contact with said pickets of said railing system and with a surface of said lower side portion when said lower side portion is secured to said lower cover portion;
- wherein said lower side portion is secured to said lower cover portion by engagement of said lower third connectors with said lower first connectors and by engagement of said lower fourth connectors with said lower second connectors.

14. The lower rail of claim 13, wherein said lower first connectors comprise a rounded slot, wherein said lower third connectors comprise a hooked edge and wherein said engagement of said lower third connectors with said lower first connectors comprise said hooked edge engaging said rounded slot.

15. The lower rail of claim 13, wherein said lower second connectors comprise a slanted edge, wherein said lower fourth connectors comprise a protrusion and wherein said engagement of said lower fourth connectors with said lower second connectors comprises said protrusion engaging said slanted edge.

16. The lower rail of claim 13, wherein said lower side portion further comprises one or more dampener retainers for attaching said dampeners to said lower side portion.

17. The lower rail of claim 13, wherein said lower cover portion further comprises a first wall extending generally downwardly from said lower shelves and a ledge extending from said first wall, wherein said ledge engages with said pickets of said railing system when said lower side portion is secured to said lower cover portion.

18. The lower rail of claim 13 further comprising a base portion, wherein said base portion engages with said lower bottom surface.

19. A railing system comprising:

a plurality of pickets;

an upper rail, said upper rail comprising:

an elongated cover portion comprising:

an elongated top surface;

one or more first connectors, wherein said first connectors are proximate to a lateral end of said top surface;

a plurality of shelves, wherein at least some of said plurality of shelves extend between successive ones of said pickets, each of said shelves comprising a first end;

one or more second connectors, wherein each of said second connectors extends from at least some of said first ends;

an elongated side portion comprising:

one or more third connectors, wherein said third connectors are adapted to engage with said one or more first connectors;

one or more fourth connectors, wherein said fourth connectors are adapted to engage with said one or more second connectors; and one or more upper dampeners, wherein said upper dampeners are in contact with said pickets and with a surface of said side portion when said side portion is secured to said cover portion;

wherein said side portion is secured to said cover portion by engagement of said third connectors with said first connectors and by engagement of said fourth connectors with said second connectors; and a lower rail, said lower rail comprising:

an elongated lower cover portion comprising:

a plurality of lower shelves, wherein at least some of said lower shelves extend between successive ones of said pickets, each of said lower shelves comprising a first lower end;

one or more lower first connectors, wherein each of said lower first connectors extend from at least some of said lower first ends;

an elongated lower bottom surface;

one or more lower second connectors, wherein said lower second connectors are proximate to a lateral end of said lower bottom surface:

an elongated lower side portion comprising:

one or more lower third connectors, wherein said lower third connectors are adapted to engage with said one or more lower first connectors;

one or more lower fourth connectors, wherein said lower fourth connectors are adapted to engage with said one or more lower second connectors; and one or more lower dampeners, wherein said lower dampeners are in contact with said pickets and with a surface of said lower side portion when said lower side portion is secured to said lower cover portion;

wherein said lower side portion is secured to said lower cover portion by engagement of said lower third connectors with said lower first connectors and by engagement of said lower fourth connectors with said lower second connectors.

* * * * *